US012677943B2

(12) United States Patent
Wang et al.

(10) Patent No.: US 12,677,943 B2
(45) Date of Patent: Jul. 14, 2026

(54) BATHROOM WARDROBE

(71) Applicant: A&C FUTURE, INC., Irvine, CA (US)

(72) Inventors: Jiuqi Wang, Santa Ana, CA (US); Qiyin Pan, Irvine, CA (US); Shoue Chen, Irvine, CA (US); Han Qin, Newport Beach, CA (US); Jiayang Qin, Newport Beach, CA (US)

(73) Assignee: A&C FUTURE, INC., Irvine, CA (US)

( * ) Notice: Subject to any disclaimer, the term of this patent is extended or adjusted under 35 U.S.C. 154(b) by 148 days.

(21) Appl. No.: 18/402,602

(22) Filed: Jan. 2, 2024

(65) Prior Publication Data

US 2025/0213039 A1 Jul. 3, 2025

(51) Int. Cl.
*A47B 88/42* (2017.01)
*A47B 67/04* (2006.01)

(52) U.S. Cl.
CPC ..... *A47B 88/42* (2017.01); *A47B 67/04* (2013.01)

(58) Field of Classification Search
CPC ..... A47B 67/00; A47B 67/04; A47B 46/00; A47B 88/403
USPC ..... 312/289
See application file for complete search history.

(56) References Cited

U.S. PATENT DOCUMENTS 2,466,378 A 4/1949 Charteris
5,100,196 A * 3/1992 Dodgen ..... B60R 15/02 296/156
5,755,498 A * 5/1998 Cutler ..... A47B 46/00 312/278
6,447,048 B2 9/2002 Crean
6,565,144 B1 * 5/2003 Crean ..... B60P 3/34 296/168
8,322,803 B2 * 12/2012 Guzzo, Jr. ..... H04Q 1/026 312/289
11,051,613 B1 * 7/2021 Gilbreath ..... E05B 65/46
2003/0107307 A1 * 6/2003 Chen ..... A47B 46/00 312/289
2005/0161974 A1 7/2005 Atcravi
2010/0170034 A1 7/2010 Bathurst et al.
2012/0194042 A1 * 8/2012 Greenberg ..... A47B 51/00 312/107
2014/0265779 A1 * 9/2014 Tsai ..... A47B 88/403 312/286
2015/0022067 A1 * 1/2015 Lee ..... A47B 71/00 312/283
2023/0064596 A1 3/2023 Niemela et al.
2025/0009124 A1 * 1/2025 Wang ..... A47B 33/00

* cited by examiner

*Primary Examiner* — Daniel J Rohrhoff
(74) *Attorney, Agent, or Firm* — INNOVATION CAPITAL LAW GROUP, LLP; Vic Lin

(57) ABSTRACT

A storage solution addresses the challenge of underutilized space in small areas. Specifically designed for compact spaces, the storage solution can seamlessly integrate with the shower when not in use, effectively saving room space. This solution is versatile and well-suited for applications in recreational vehicles or other environments with limited interior space. The storage solution can take the form of a wardrobe or closet. Moreover, the closet features dual-directional openings, including doors and drawers, allowing for maximum utilization of confined spaces. The lower section is also optimized to accommodate variations in height between the shower and the floor.

20 Claims, 12 Drawing Sheets

BATHROOM WARDROBE

BACKGROUND OF THE INVENTION

1. Field of the Invention

Embodiments of the invention relate generally to wardrobes and closets. More particularly, embodiments of the invention relate to a wardrobe that can move between a stored position, located above a device not used during storage of the wardrobe, and a use position, located away from the device to permit its use, where the wardrobe has its interior accessible in both the stored and the use positions.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Small structures, such as recreational vehicles, tiny houses, small apartments, or the like, try to conserve space in efforts to maximize uses of the available square footage. Closets or wardrobes can be difficult to use in such small spaces as such rooms typically occupy a relatively large amount of floor space and may or may not be fully utilized by the user.

In view of the foregoing, there is a need for a providing a closet or wardrobe in a space that can be utilized while also being storable to maximize open space within the structure.

SUMMARY OF THE INVENTION

Embodiments of the present invention aim to solve the aforementioned problems in conventional closets by providing a movable closet that can be stored over a shower while still allowing access to an interior thereof.

Embodiments of the present invention provide a storage structure moveable between a stored position and a use position comprising a base portion operable to provide a height adjustment of the storage structure between a stored position height and an use position height, wherein the base portion automatically moves between the stored position height and the use position height as the storage structure is moved between the stored position and the expanded position; and access doors to access an interior of the storage structure, at least one of the access doors permitting access into the interior when the storage structure is in the stored position, and at least another one of the access doors permitting access into the interior when the storage structure is in the use position.

Embodiments of the present invention provide a storage structure moveable between a stored position and a use position comprising an upper drawer positioned above a lower drawer, each of the upper drawer and the lower drawer accessible from either a first side of the storage structure, by opening the upper or lower drawer in a first drawer direction, or a second side of the storage structure, by opening the upper or lower drawer in a second drawer direction, the first side being adjacent the second side; and access doors to access an interior of the storage structure, at least one of the access doors permitting access into the interior when the storage structure is in the stored position, and at least another one of the access doors permitting access into the interior when the storage structure is in the use position, wherein each of the upper drawer and the lower drawer include a first drawer face on the first side and a second drawer face on the second side.

Embodiments of the present invention provide a storage structure moveable between a stored position and a use position comprising an upper drawer positioned above a lower drawer, each of the upper drawer and the lower drawer accessible from either a first side of the storage structure, by opening the upper or lower drawer in a first drawer direction, or a second side of the storage structure, by opening the upper or lower drawer in a second drawer direction, the first side being adjacent the second side; and a first drawer slide and a second drawer slide attached to each of the upper drawer and the lower drawer, the first drawer slide permitting movement of the upper drawer or the lower drawer in the first drawer direction, and the second drawer slide permitting movement of the upper drawer or the lower drawer in the second drawer direction, wherein each of the upper drawer and the lower drawer include a first drawer face on the first side and a second drawer face on the second side.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 2:
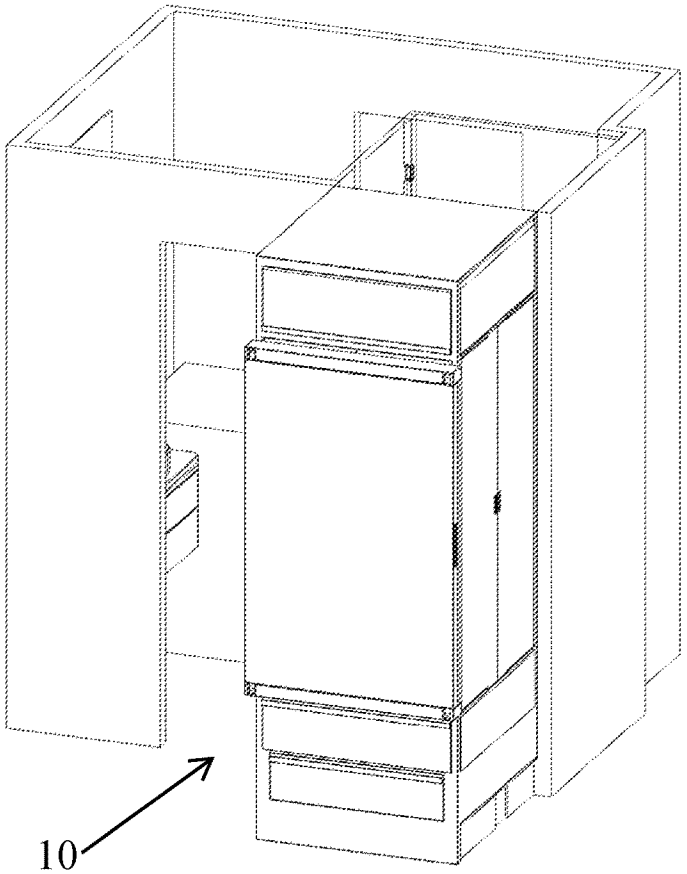
FIG. 2 illustrates a perspective view of the wardrobe of FIG. 1, positioned outside of the bathroom, as a use position.

The illustrations in the figures may not necessarily be drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature (s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a storage solution that addresses the challenge of underutilized space in small areas. Specifically designed for compact spaces, the storage solution can seamlessly integrate with the shower when not in use, effectively saving room space. This solution is versatile and well-suited for applications in recreational vehicles or other environments with limited interior space. The storage solution can take the form of a wardrobe or closet. Moreover, the closet features dual-directional openings, including doors and drawers, allowing for maximum utilization of confined spaces. The lower section is also optimized to accommodate variations in height between the shower and the floor.

Aspects of the present invention are briefly described below, followed by a more detailed discussion of each figure and the components therein.

Given the inevitable height disparity between the bathroom floor and the shower area—typically arising from the need for plumbing accommodations—the closet needs to seamlessly adapt to this discrepancy upon being positioned in the bathroom. To address this challenge, the lower section of the closet is equipped with a folding bracket. This mechanism automatically elevates when encountering the height difference in the bathroom.

Simultaneously, to optimize the functionality of the bathroom closet, it incorporates a versatile two-way open design. This includes an interior rod extending in the opposite direction, a lower drawer capable of opening in either direction, and a top cabinet with dual-directional opening features.

The closet can include support legs, which, broadly, are mechanisms designed to compensate for the height differential of the closet once it is pulled out of the shower. Details of this mechanism are discussed below with reference to the figures. In general terms, adjacent to the direction of movement, there are two plates positioned at the base of the closet, capable of rotation. One of these plates is situated at the far right end, and its extremities are affixed to the plates covering the external bottom support. The external shelter plate is divided into two segments. The section adjacent to the bathroom end features a slot for connecting the plate perpendicular to the direction of movement. The other end of this plate is centrally hollow, facilitating the attachment of the additional plate covering the bottom bracket. This arrangement allows the terminal part of the supplementary plate to be securely fastened within the hollow portion of the former plate.

Depending on the perpendicular movement of the plate, it undergoes a circumferential upward motion around a pivotal point, securing itself into a designated slot and completing the tightening process. Conversely, the other plate can only execute an upward movement to fasten into a specific slot since one end is constrained by the cabinet. The lower section of this plate is equipped with an additional bracket, attached in a similar fashion, ensuring proper movement execution. The portion close to the bathroom can be stowed within another plate, as previously described, concealing the bracket.

The closet can further involve a drawer system including stacking rails on top of each other. The lower layer of rails, affixed to the cabinet, is retractable in one direction. On top of this layer, another rail is mounted, unfolding vertically. Additionally, the drawer features two panels. When pulled out in one direction, the opposite drawer panel remains within the cabinet, securing and restricting movement in the other direction.

A folding coffee table, or other similar folding furniture item, can be hung from the door handle of the cabinet after stowing the shower.

As used herein, the term "closet" can refer to a storage solution having an interior section for storing items. Such a closet can be a cabinet, a wardrobe, or the like.

Figure 1:
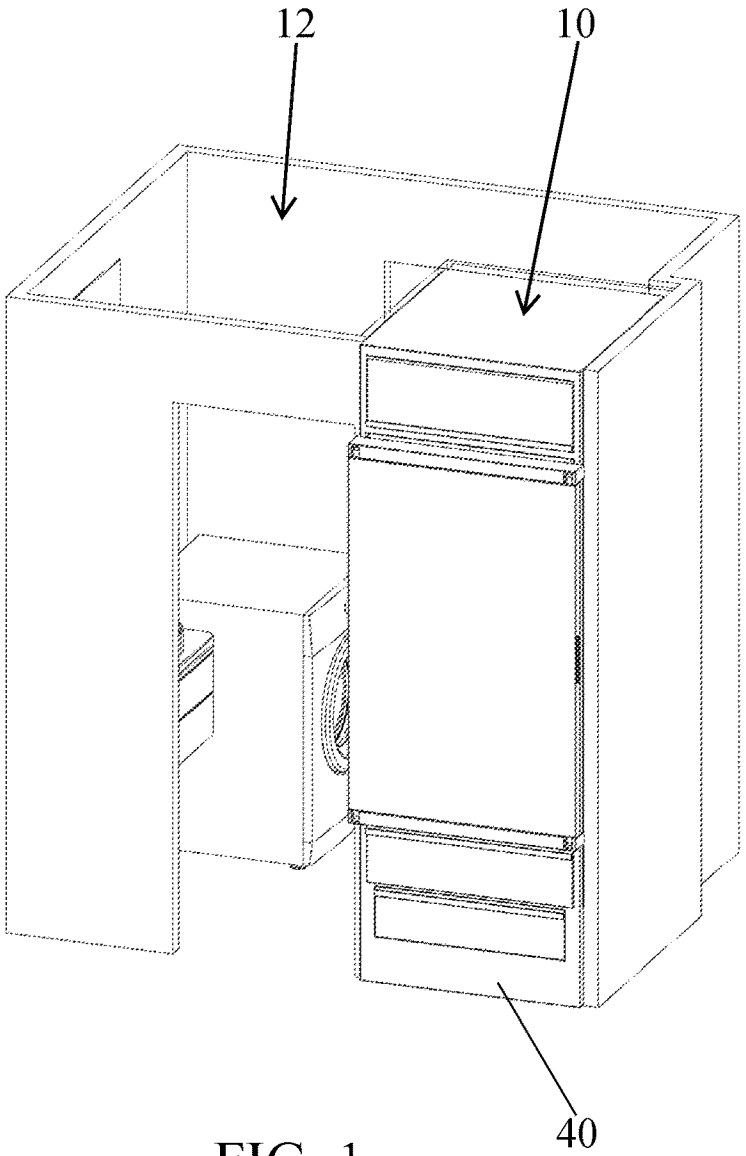
FIG. 1 illustrates a perspective view of a wardrobe, positioned over a shower base in a bathroom, as a stored position, according to an exemplary embodiment of the present invention.

Referring to FIGS. 1 and 2, a closet 10 can be movable between a stored position, within another room 12 above a structure in that room, as shown in FIG. 1, and a use position, with the closet 10 positioned outside of the other room, as shown in FIG. 2. For example, in the stored position can be positioned above a shower floor (such as a shower pan, a shower drain, or the like) within a bathroom. In the use position, the closet 10 can form an exterior wall of the shower of the bathroom and can be positioned in a different room, such as a bedroom, for example.

Figure 4:
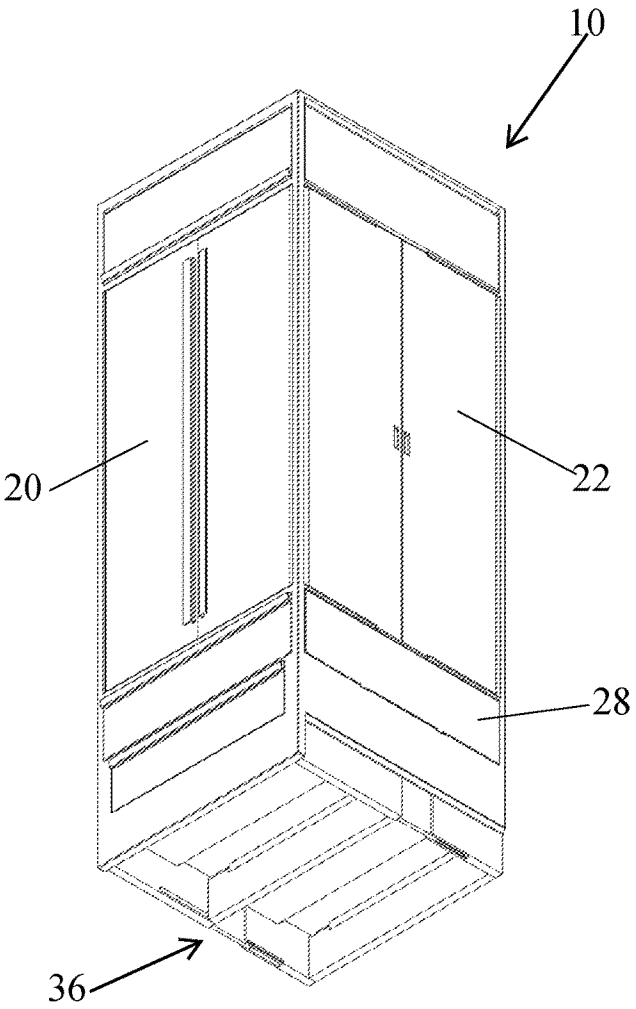
FIG. 4 illustrates a bottom perspective view of the wardrobe of FIG. 1.
Figure 3:
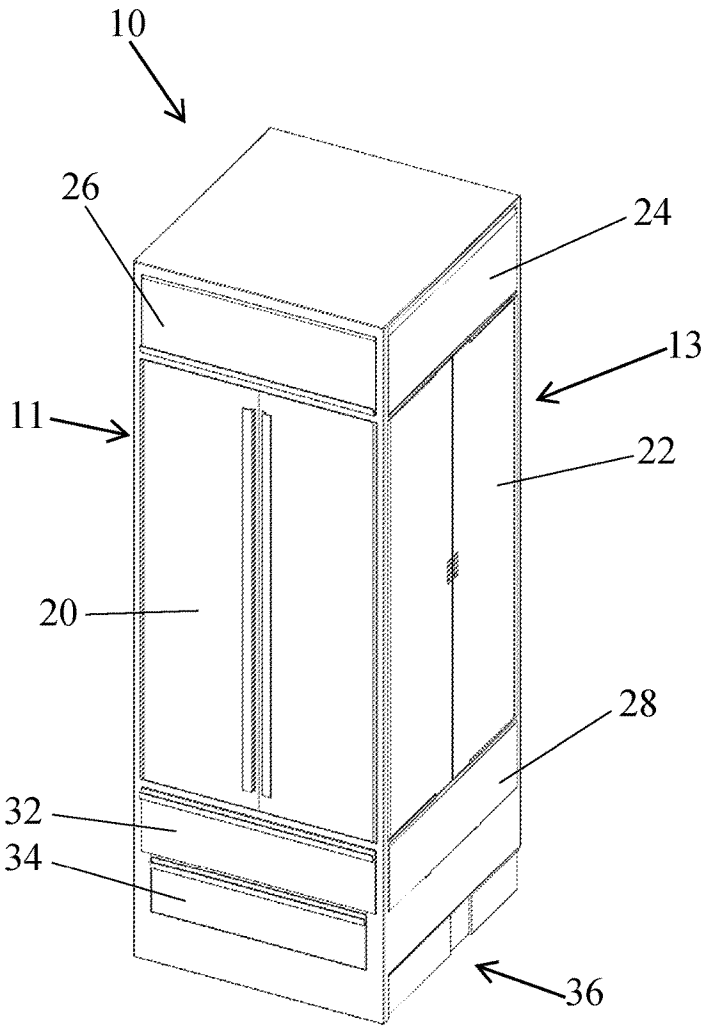
FIG. 3 illustrates a top perspective view of the wardrobe of FIG. 1.

Referring to FIGS. 3 and 4, the closet 10 can be accessed from two sides thereof, where, in the stored position, one of the access sides can still provide access to the interior of the closet 10, while in the use position, one or both of the access sides can provide access to the interior of the closet 10. Thus, the functionality of the closet 10 is not lost, even when stored above the shower pan.

In greater detail, a first access side 11 can provide accessibility to the interior of the closet 10 with the closet 10 is in the stored position. In some embodiments, the first access side 11 may also provide access to the interior of the closet 10 when the closet 10 is in the use position. The first access side 11 can include a first side upper door 26 to access an upper cabinet, a wardrobe door 20 to access a wardrobe portion of the closet 10, and drawers, including an upper drawer 32 and a lower drawer 34, for example, for pulling forward to open upper and lower drawers 32, 34. A base structure 36, as described in greater detail below, can provide a height adjustable base that can adjust its height as the closet 10 is moved between the stored and use positions.

Similarly, a second access side 13 can provide accessibility to the interior of the closet 10 with the closet 10 is in the use position. Typically, the second access side 13 is blocked when the closet 10 is in the stored position. The second access side 13 can include a first side upper door 24 to access an upper cabinet, a wardrobe door 22 to access a wardrobe portion of the closet 10, and an upper drawer 28, for pulling forward to open the upper 28. It should be understood that the upper drawer 28 and the upper drawer 32 provide access to the same storage space within the upper drawer. The difference is in the way access is gained by pulling the drawer "forward". The forward direction for the upper drawer 32 on the first access side 11 is orthogonal to the forward direction for the upper drawer 28 on the second access side 13. In other words, the first access side 11 may be provided on one wall of the closet 10 and the second access side 13 may be provided on an adjacent wall of the closer 10. It should be noted that the lowermost drawer is only operable in one (forward) direction. This is due to the need for the base portion to raise up into the sides of the closet when in the stored position. Thus, there is no drawer on the second access side 13 at the lowermost position.

While a specific configuration is shown and described, it should be understood that the present invention should not be so limited to a particular configuration. For example, the upper cabinet may be changed to two upper cabinets or no upper cabinets. The wardrobe may be an open space inside for hanging clothes or may be shelves, or the like. The two lower drawers may be a single lower drawer or multiple drawers stacked on top of each other. In some embodiments, the wardrobe may be replaced by smaller cabinets or additional drawers. Of course, even other configurations not specifically described may be contemplated within the scope of the present invention.

Figure 5:
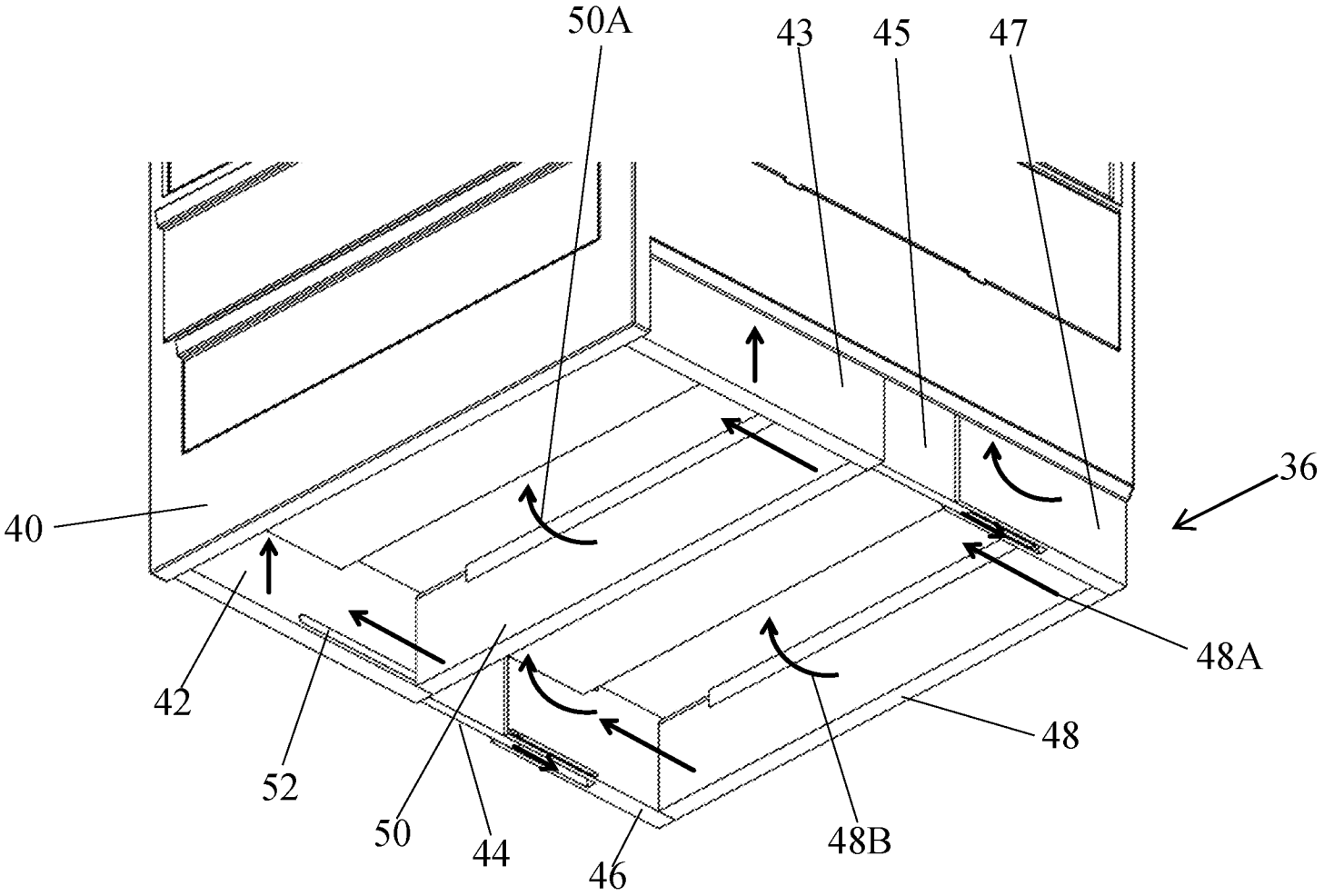
FIG. 5 illustrates a detailed bottom perspective view of the wardrobe of FIG. 1, showing motion of a movable base portion thereof.
Figure 6:
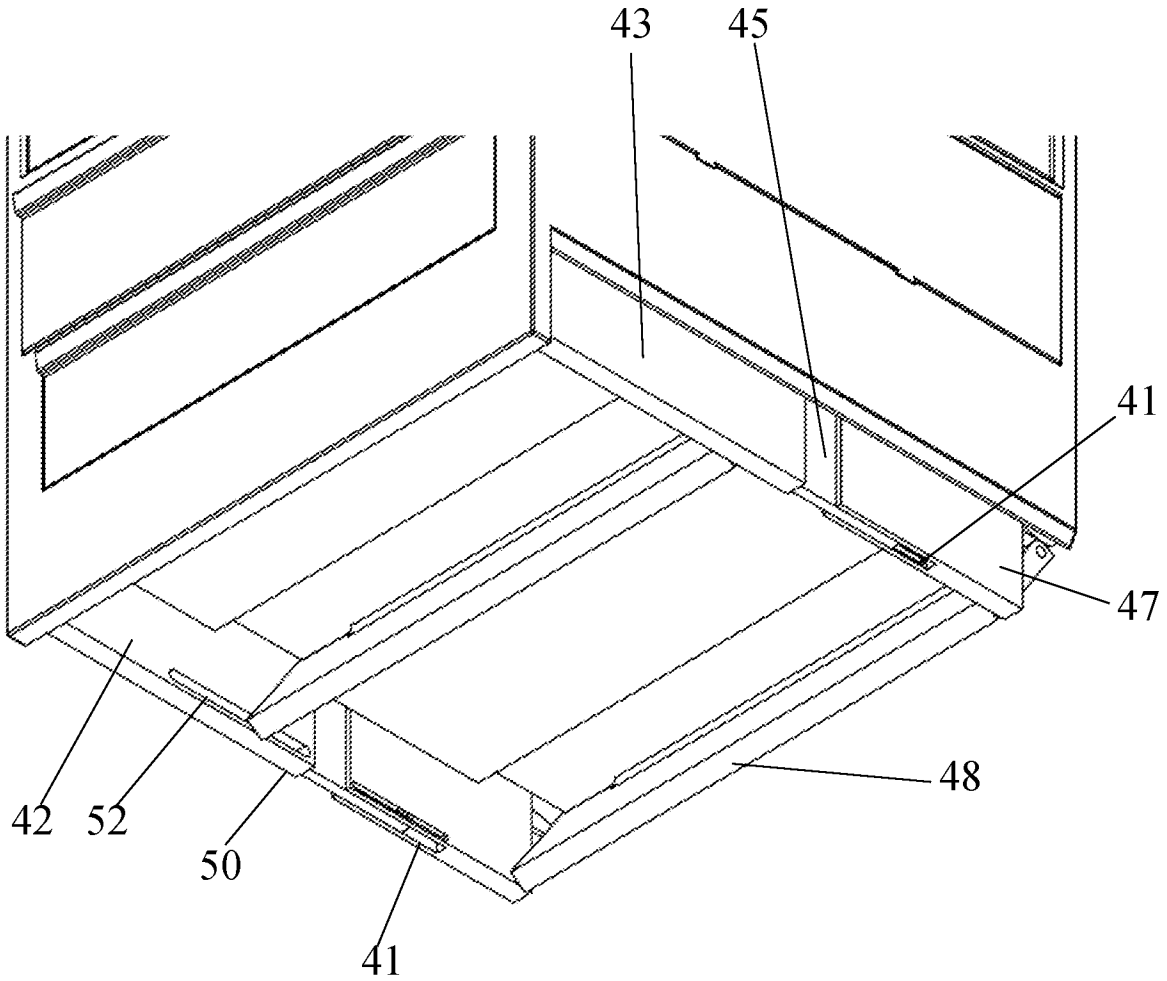
FIG. 6 illustrates a detailed bottom perspective view of the wardrobe of FIG. 1, showing the movable base portion in a partially recessed position.
Figure 7:
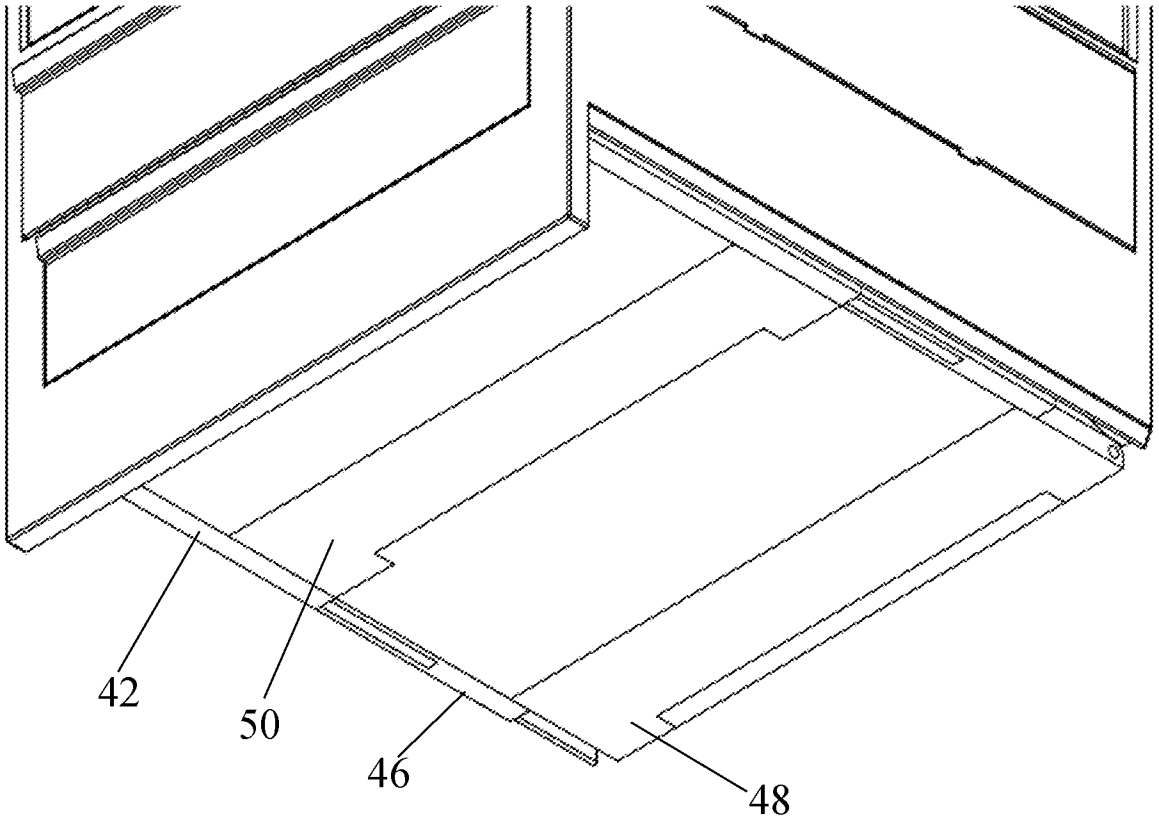
FIG. 7 illustrates a detailed bottom perspective view of the wardrobe of FIG. 1, showing the movable base portion in a fully recessed position.

Referring now to FIGS. 5 through 11, the operation of the base structure 36 is illustrated. In FIGS. 5 through 7, a folding operation is shown in three stages. FIG. 5 shows the base structure 36 before folding (with the closet in the use position). The base structure can include a fixed side 40 that forms a non-height adjustable side of the closet that spans to a floor surface (not shown). The other three sides of the base structure can be folded up permit the closet to rest on a raised structure, such as a shower pan (not shown). The fixed side 40 forms an exterior of the closet 10 when in the stored position as shown in FIG. 1. The fixed side 40 may also be referred to as a forward panel of the base structure 36. In other words, as the closet 10 is moved from the stored position (FIG. 1) to the use position (FIG. 2), the direction of movement is perpendicular to the plane of the fixed side 40 of the closet 10. The discussion below will now focus on the movable structures of the base structure 36.

As the closet is moved toward the stored position (moved in a direction opposite to that of arrow 48A), an rear panel 48 may both move in the direction shown by arrow 48A and may also pivot as shown by arrow 48B. At the same time, a central panel 50, that is generally parallel with the rear panel 48, may also rotate in the direction shown by arrow 50A. The central panel 50 may interact with slots 52 formed on an interior of a left forward side panel 42 and a right forward side panel 43. As the central panel 50 rotates, the interaction of the central panel 50 with the slots 52 can move the side walls (including the left forward side panel 42, the right forward side panel 43, the left rear side panel 46, the right rear side panel 47, the left biscuit panel 44 and the right biscuit panel 45) upward, into a space 49 (see FIG. 7, for example) formed on the left and right sides of the closet, below the drawers.

As the rear panel 48 pivots in the direction of arrow 48B, the right and left rear side panels 46, 47 may be moved forward as they are raised upward into the closet. To accommodate this forward movement, slots 41 may be formed on a forward end of each of the right and left rear side panels 46, 47. The slots 41 may receive the right and left side biscuit panels 44, 45 therein as the right and left rear side panels 46, 47 move forward (as shown by arrow 48A). The right and left side biscuit panels 44, 45 may be attached to the left and right forward side panels 42, 43 and extend rearward therefrom, as shown. In some embodiments, the right and left side biscuit panels 44, 45 may be a thinned portion of the left and right forward side panels 42, 43.

Once fully folded, as shown in FIG. 7, the rear panel 48 and the central panel 50 may be disposed perpendicular to their respective positions in the use position (FIG. 5). The side panels (42, 43, 44, 45, 46, 47) may be hidden in the space 49 in the sides of the closet, while the fixed panel 40 remains in its original position.

Figure 8:
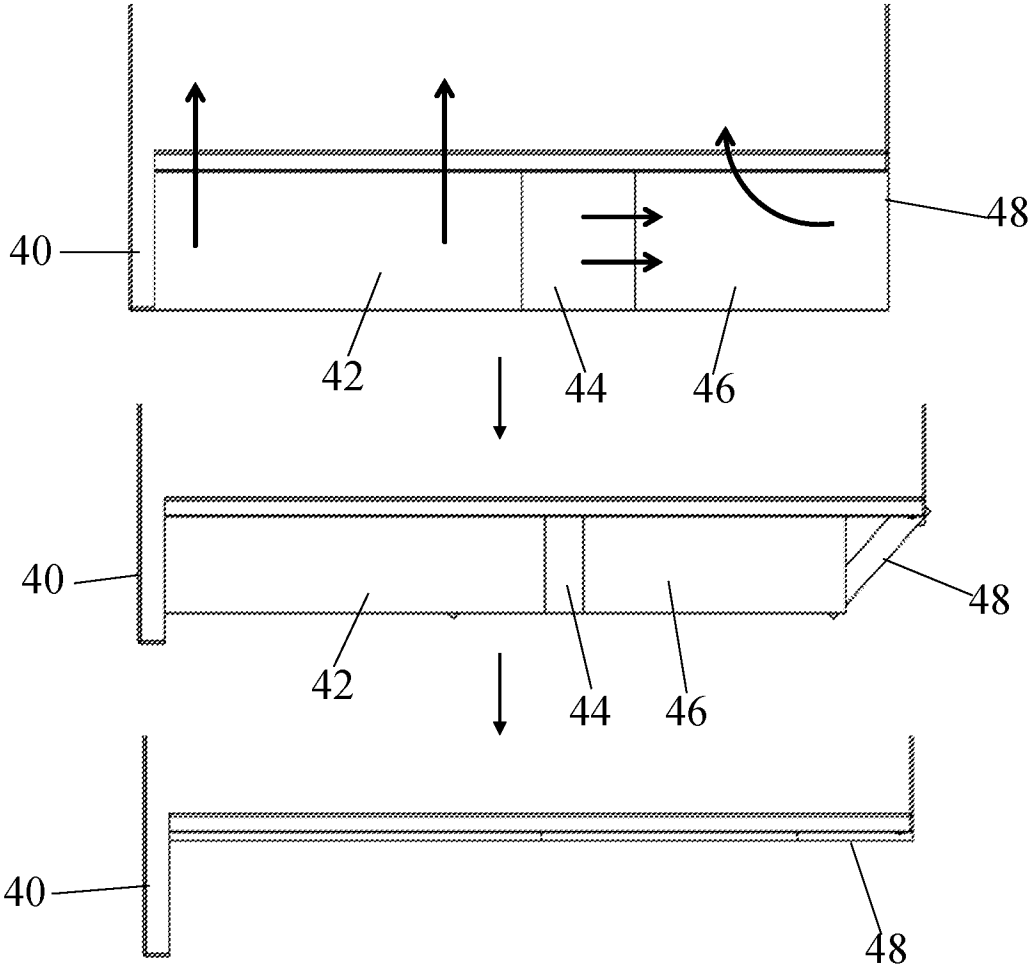
FIG. 8 illustrates a side view showing a step-wise progression as the movable base portion moves into the fully recessed position.

FIG. 8 shows a cross sectional view illustrating the same folding process shown in FIGS. 5 through 7, where the upper image in FIG. 8 corresponds to FIG. 5, the middle image in FIG. 8 corresponds to FIG. 6 and the lower image in FIG. 8 corresponds to FIG. 7. A similar progression is shown in the three images in each of FIGS. 10 and 11.

Figure 9:
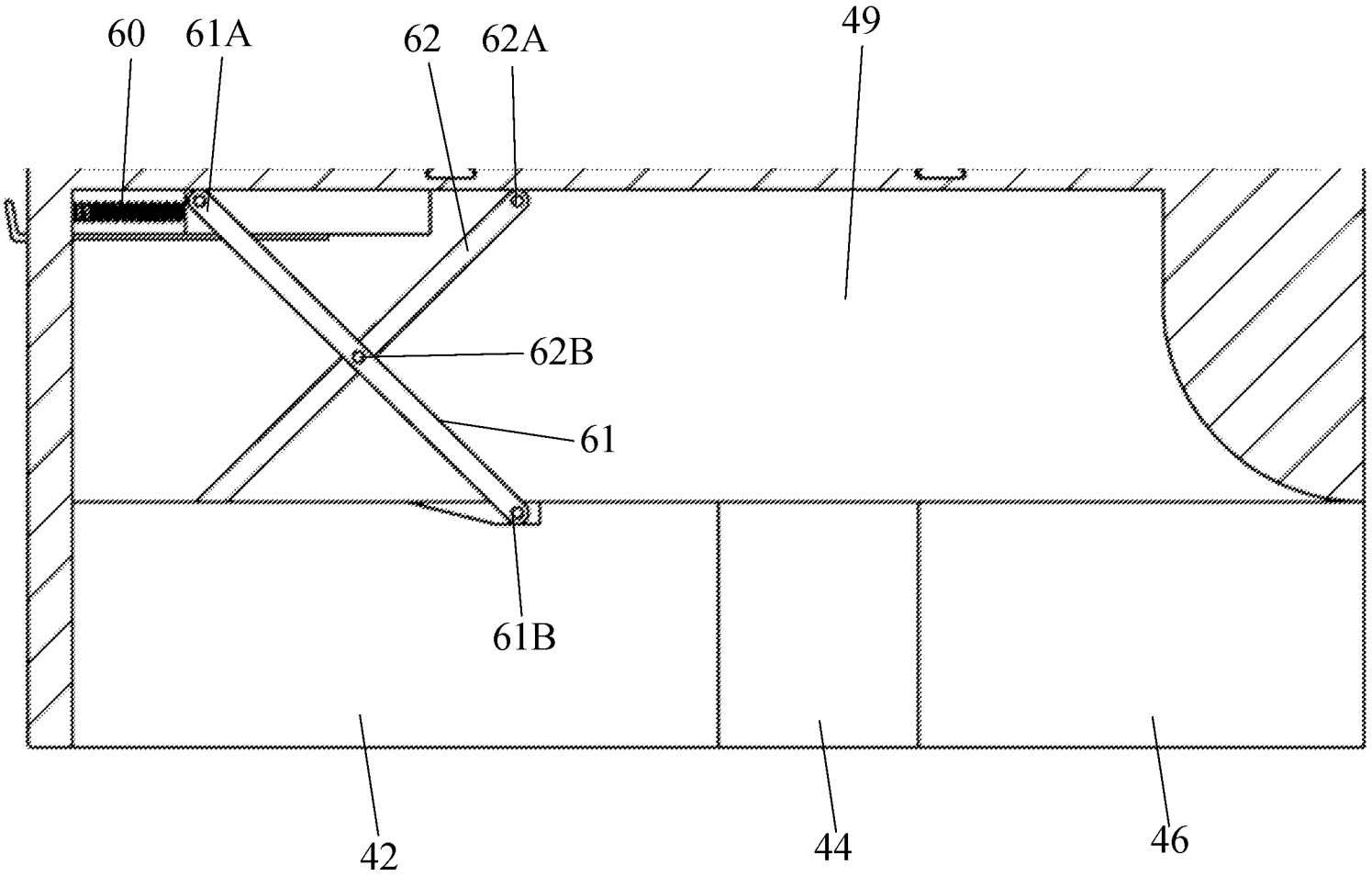
FIG. 9 illustrates a side cross-sectional view of the lower part of the wardrobe of FIG. 1, showing a spring-loaded connector urging the movable base portion into the extended position.
Figure 11:
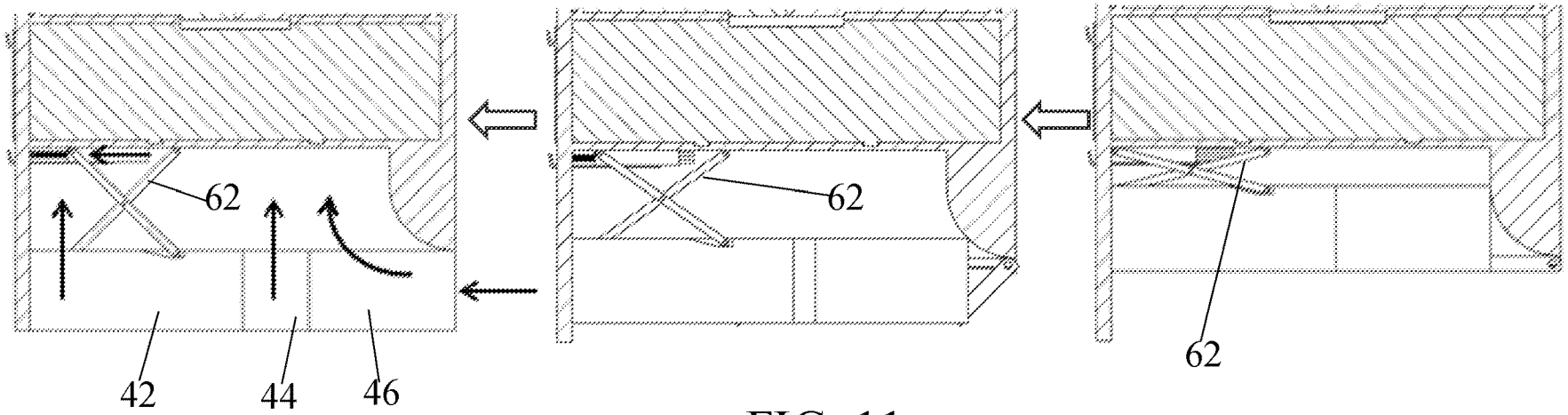
FIG. 11 illustrates a side cross-sectional view of the lower part of the wardrobe of FIG. 1, showing the function of the spring-loaded connector of FIG. 9 during movement of the movable base portion into the recessed position.

Referring to FIGS. 9 and 11, another side cross-sectional view is shown, where a resilient member is shown. The resilient member can include a first arm 61 that is attached, at its first end 61A, to a resiliently deformable member, such as a spring 60, and that is attached, at its second, opposite end 61B, to the left forward side panel 42. A second arm 62 may have its first end 62A fixed to the closet and its second end slidable along the left forward side panel 42. A central portion of the first and second arms 61, 62 may be pivotably joined together at a pivot connection 62B. When in the use position, the first and second arms 61, 62 may form an angle from 70 to 110 degrees, typically at about 90 degrees, as shown in FIG. 9. The spring 60 may urge the first end 61A of the first arm 61 toward the first end 62A of the second arm 62A. During folding (moving of the closet toward the stored position), the first end 61A of the first arm 61 may press against the resiliency of the spring 60 as the side panels are moved into the space in the sides of the closet. The spring 60 may be used to automatically lower the side walls as the closet is moved from the stored position to the use position.

Figure 10:
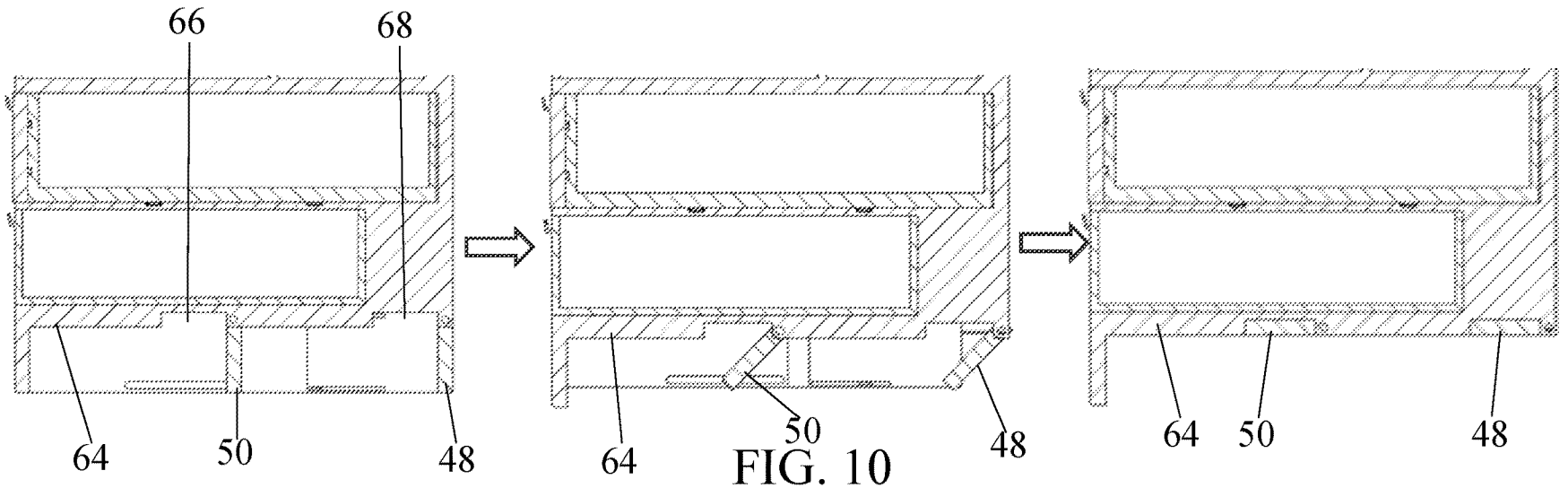
FIG. 10 illustrates a side cross-sectional view of the lower part of the wardrobe of FIG. 1, showing the movement of components of the movable base portion.

As can best be seen in FIG. 10, once the closet is in the stored position, the rear panel 48 may be disposed in a first space 68 in the base member 64 and the central panel 50 may be disposed in a second space 66 in the base member 64. Thus, once fully folded, as shown in the right most image in FIG. 10, the base member 64 can be flush with the rear panel 48 and the central panel 50.

Figure 12:
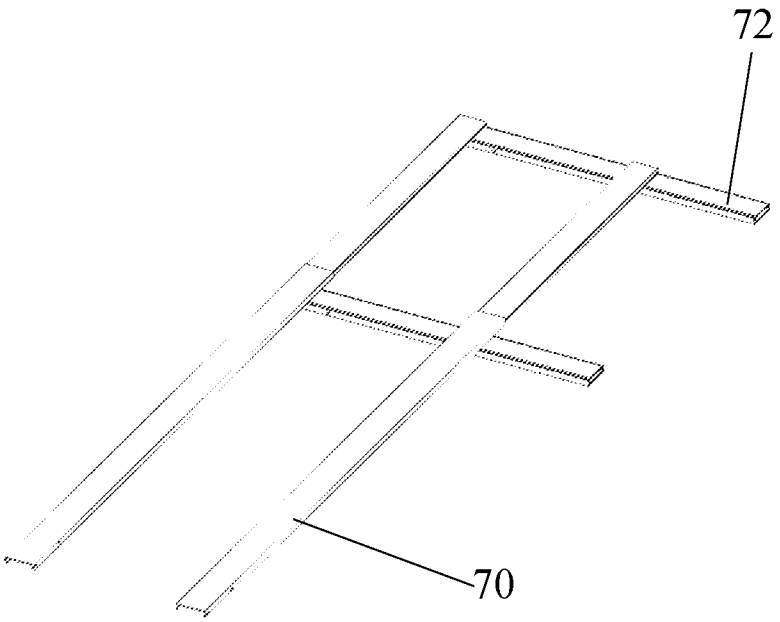
FIG. 12 illustrates a perspective view of a set of drawer tracks illustrating movement of an upper set of tracks into a drawer extension position.
Figure 15:
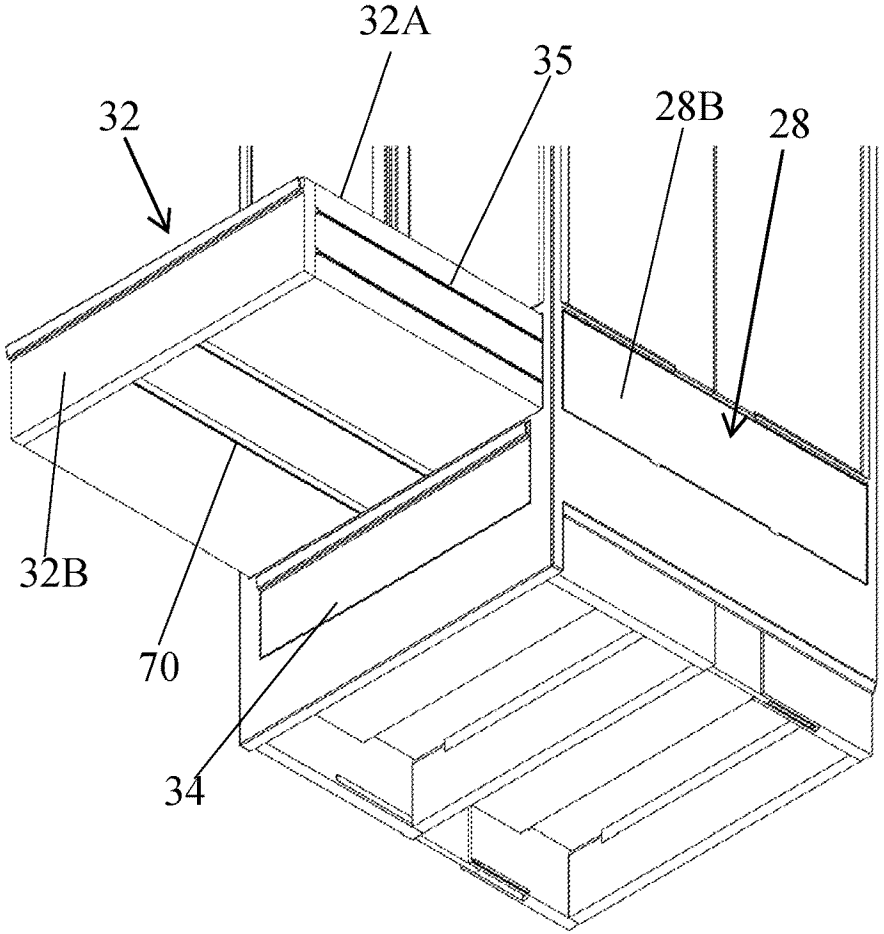
FIG. 15 illustrates a bottom perspective view of the wardrobe of FIG. 1, showing the opening of a front drawer using the upper track extension shown in FIG. 12.

Referring now to FIGS. 12 through 15, the operation of the upper and lower drawers is described. In FIG. 12, forward moving drawer slides 70 are shown in the extended position, while side moving drawer slides 72 are shown in the retracted position. As used herein, forward moving refers to moving the drawers 32, 34 outward, while side moving refers to moving the drawer 28 outward. FIG. 12 corresponds to the drawer position of FIG. 15. As drawer 32 is moved outward, as shown in FIG. 15, the drawer slides 70 can extend (as shown in FIG. 12). The drawer may further move along guides 35, formed on the sides 32A of the drawer 32. The guides 35 may interact with a back side of the front panel 28B of the drawer 28. Thus, the upper drawer can move forward as shown in FIG. 15 while the front panel 28B of the drawer 28 remains in place. The guides 35 may also hold the front panel 28B in place when the drawer 32 is extended.

Figure 13:
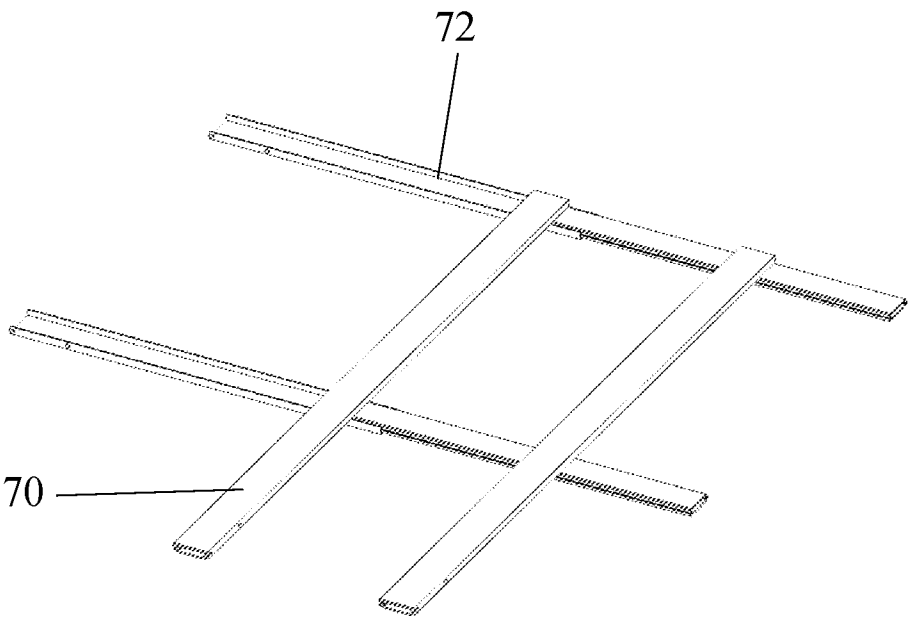
FIG. 13 illustrates a perspective view of the set of drawer tracks of FIG. 12, showing movement of a lower set of tracks into a drawer extension position.
Figure 14:
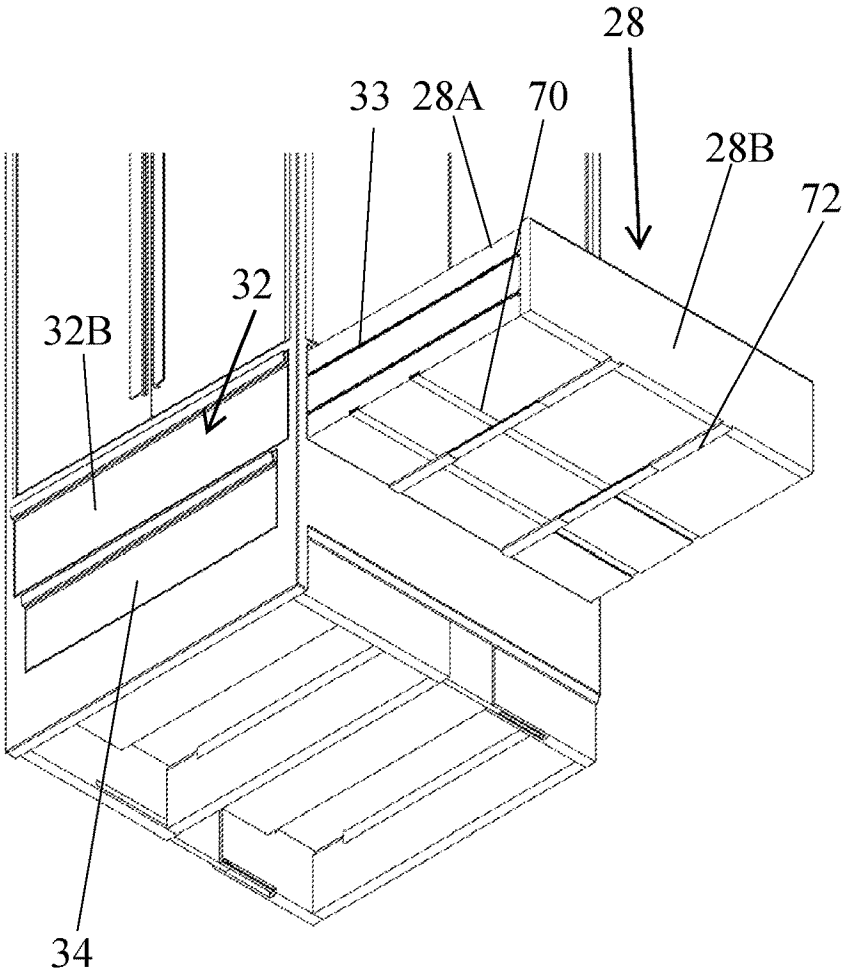
FIG. 14 illustrates a bottom perspective view of the wardrobe of FIG. 1, showing the opening of a side drawer using the lower track extension shown in FIG. 13.

Similarly, as shown in FIGS. 13 and 14, the side moving drawer slides 72 can be in the extended position, while the forward moving drawer slides 70 are in the retracted position. The drawer 28 can extend out in a sideward motion as shown in FIG. 14 and both the side moving drawer slides 72 and the forward moving drawer slides 70 may be under the drawer 28. The drawer 28 may further move along guides 33 formed on the sides 28A of the drawer 28. The guides 33 may interact with a back side of the front panel 32B of the drawer 32. Thus, the upper drawer 28 can move in a sideward direction as shown in FIG. 14, while the front panel 32B of the drawer 32 remains in place. The guides 33 may also hold the front panel 32B in place when the drawer 28 is extended.

Figure 17:
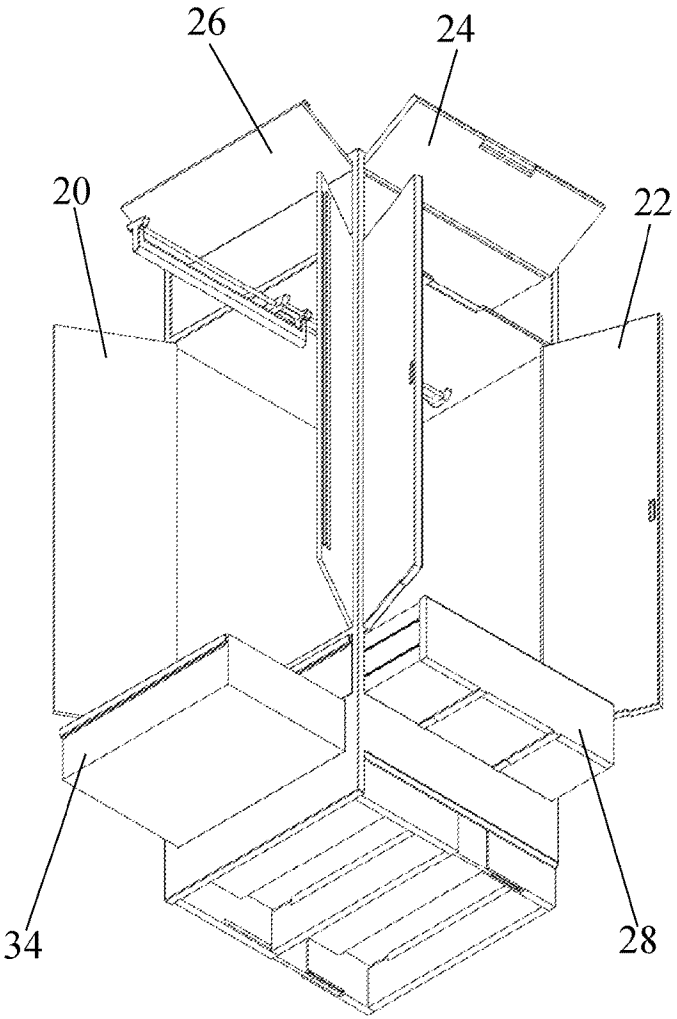
FIG. 17 illustrates a bottom perspective view of the wardrobe of FIG. 1 with its drawers and cabinets opened.
Figure 16:
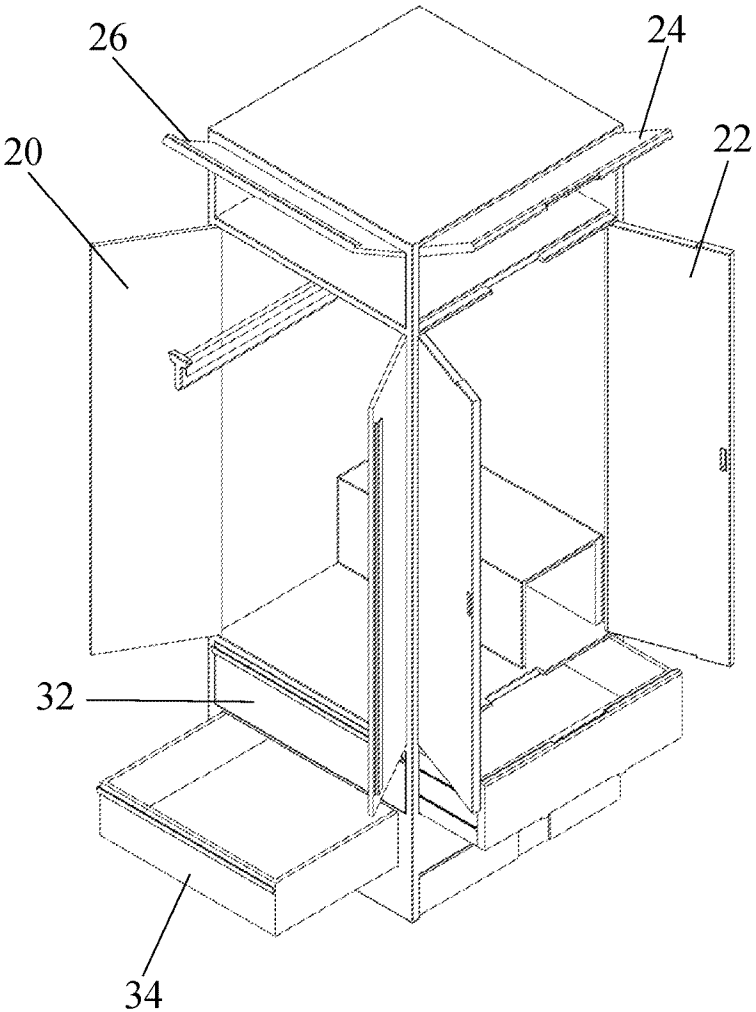
FIG. 16 illustrates a top perspective view of the wardrobe of FIG. 1 with its drawers and cabinets opened.

FIGS. 16 and 17 illustrates top and bottom perspective views of the closet, in its use position, with multiple drawers and cabinets opened to provide access to an interior thereof.

Figure 19:
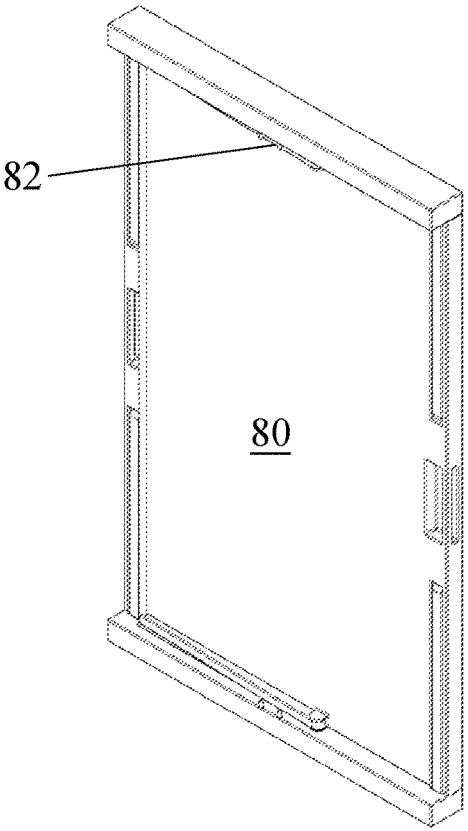
FIG. 19 illustrates a bottom perspective view of the furniture accessory item of FIG. 18, showing a mounting connector used to secure the item to the wardrobe.
Figure 18:
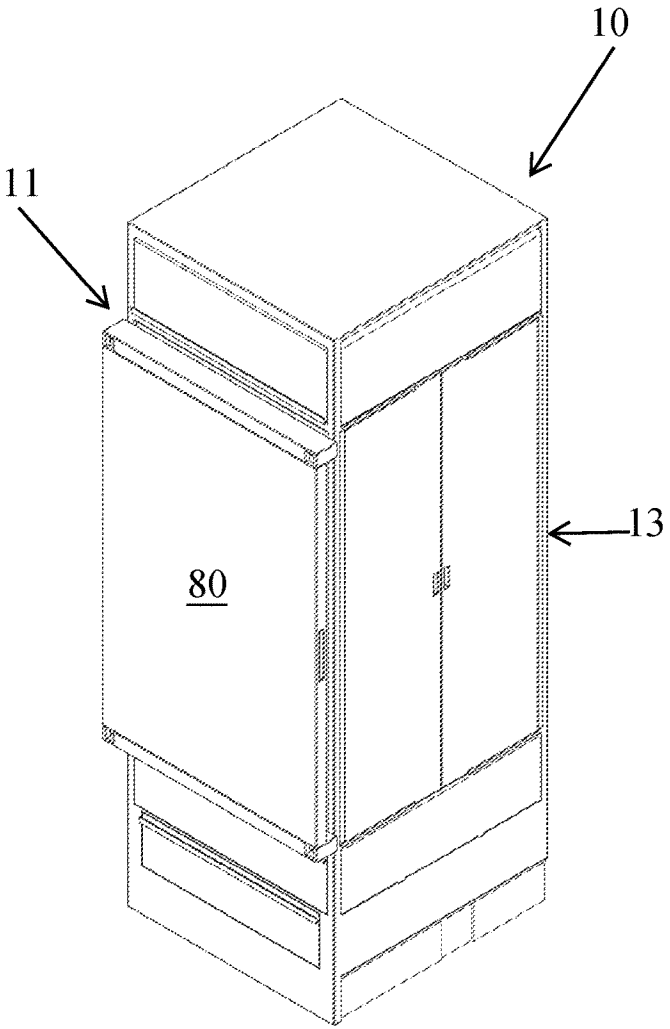
FIG. 18 illustrates how a furniture accessory item, such as a foldable table, can be stored on the wardrobe of FIG. 1.

FIGS. 18 and 19 illustrate an optional furniture item, such as a folding table 80, that may be stored on a first side of the closet 10. Thus, the table 80 may be accessible while the closet is in the stored position or the use position. The table 80 may include an attachment mechanism 82 that can permit the table to be secured to the first side 11 of the closet 10. The attachment mechanism 82 can include a protruding arm, a lock tab and slot, a magnetic member, or the like, provided that the attachment mechanism 82 can secure the table 80 to the closet 10 without risk of falling during, for example, movement of a recreational vehicle containing the closet 10.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A storage structure moveable between a stored position and a use position, the storage structure comprising:

a base portion operable to provide a height adjustment of the storage structure between a stored position height and an use position height, wherein the base portion automatically moves between the stored position height and the use position height as the storage structure is moved between the stored position and the use position height; and access doors to access an interior of the storage structure, at least one of the access doors permitting access into the interior when the storage structure is in the stored position, and at least another one of the access doors permitting access into the interior when the storage structure is in the use position.

2. The storage structure of claim 1, further comprising a fixed front member of the base portion, the fixed front member unmoving when the storage structure is moved between the stored position and the use position.

3. The storage structure of claim 1, further comprising a rear member of the base portion pivotable about an axis to move the rear member from a rear member first position to a rear member second position as the storage structure is moved from the use position to the stored position, the first position being orthogonal to the second position, the rear member spanning between a left side and a right side of the base portion of the storage structure.

4. The storage structure of claim 3, further comprising a central member of the base portion pivotable about an axis to move the central member from a central member first position to a central member second position as the storage structure is moved from the use position to the stored position, the first position being orthogonal to the second position, the central member spanning between the left side and the right side of base portion of the storage structure.

5. The storage structure of claim 4, wherein the left side and the right side of the base portion of the storage structure is movable upward into a storage space in the storage structure as the storage structure is moved from the use position to the stored position.

6. The storage structure of claim 5, wherein a rear portion of each of the left side and the right side of the base portion slides on a forward portion of each of the left side and the right side of the base portion as the storage structure is moved between the use position and the stored position.

7. The storage structure of claim 1, further comprising an upper drawer positioned above a lower drawer, each of the upper drawer and the lower drawer accessible from either a first side of the storage structure, by opening the upper or lower drawer in a first drawer direction, or a second side of the storage structure, by opening the upper or lower drawer in a second drawer direction.

8. The storage structure of claim 7, wherein the first side is adjacent the second side.

9. The storage structure of claim 8, wherein each of the upper drawer and the lower drawer include a first drawer face on the first side and a second drawer face on the second side.

10. The storage structure of claim 9, further comprising a first drawer slide and a second drawer slide attached to each of the upper drawer and the lower drawer, the first drawer slide permitting movement of the upper drawer or the lower drawer in the first drawer direction, and the second drawer slide permitting movement of the upper drawer or the lower drawer in the second drawer direction.

11. The storage structure of claim 10, wherein the first drawer face includes a first drawer engagement mechanism operable to slidably engage a side member of the upper drawer or the lower drawer as the upper drawer or the lower drawer is opened in the second direction.

12. The storage structure of claim 11, wherein the second drawer face includes a second drawer engagement mechanism operable to slidably engage a side member of the upper drawer or the lower drawer as the upper drawer or the lower drawer is opened in the first direction.

13. A storage structure moveable between a stored position and a use position, the storage structure comprising:

an upper drawer positioned above a lower drawer, each of the upper drawer and the lower drawer accessible from either a first side of the storage structure, by opening the upper or lower drawer in a first drawer direction, or a second side of the storage structure, by opening the upper or lower drawer in a second drawer direction, the first side being adjacent the second side; and access doors to access an interior of the storage structure, at least one of the access doors permitting access into the interior when the storage structure is in the stored position, and at least another one of the access doors permitting access into the interior when the storage structure is in the use position, wherein each of the upper drawer and the lower drawer include a first drawer face on the first side and a second drawer face on the second side.

14. The storage structure of claim 13, further comprising a first drawer slide and a second drawer slide attached to each of the upper drawer and the lower drawer, the first drawer slide permitting movement of the upper drawer or the lower drawer in the first drawer direction, and the second drawer slide permitting movement of the upper drawer or the lower drawer in the second drawer direction.

15. The storage structure of claim 14, wherein:

the first drawer face includes a first drawer engagement mechanism operable to slidably engage a side member of the upper drawer or the lower drawer as the upper drawer or the lower drawer is opened in the second direction; and the second drawer face includes a second drawer engagement mechanism operable to slidably engage a side member of the upper drawer or the lower drawer as the upper drawer or the lower drawer is opened in the first direction.

16. The storage structure of claim 13, further comprising a base portion operable to provide a height adjustment of the storage structure between a stored position height and an use position height, wherein the base portion automatically moves between the stored position height and the use position height as the storage structure is moved between the stored position and the expanded position.

17. A storage structure moveable between a stored position and a use position, the storage structure comprising:

an upper drawer positioned above a lower drawer, each of the upper drawer and the lower drawer accessible from either a first side of the storage structure, by opening the upper or lower drawer in a first drawer direction, or a second side of the storage structure, by opening the upper or lower drawer in a second drawer direction, the first side being adjacent the second side; and a first drawer slide and a second drawer slide attached to each of the upper drawer and the lower drawer, the first drawer slide permitting movement of the upper drawer or the lower drawer in the first drawer direction, and the second drawer slide permitting movement of the upper drawer or the lower drawer in the second drawer direction, wherein each of the upper drawer and the lower drawer include a first drawer face on the first side and a second drawer face on the second side.

18. The storage structure of claim 17, further comprising a base portion operable to provide a height adjustment of the storage structure between a stored position height and an use position height, wherein the base portion automatically moves between the stored position height and the use position height as the storage structure is moved between the stored position and the use position.

19. The storage structure of claim 18, further comprising:

a fixed front member of the base portion, the fixed front member unmoving when the storage structure is moved between the stored position and the use position;

a rear member of the base portion pivotable about an axis to move the rear member from a rear member first position to a rear member second position as the storage structure is moved from the use position to the stored position, the first position being orthogonal to the second position, the rear member spanning between a left side and a right side of base portion of the storage structure; and a central member of the base portion pivotable about an axis to move the central member from a central member first position to a central member second position as the storage structure is moved from the use position to the stored position, the first position being orthogonal to the second position, the central member spanning between the left side and the right side of base portion of the storage structure.

20. The storage structure of claim 19, wherein the left side and the right side of the base portion of the storage structure is movable upward into a storage space in the storage structure as the storage structure is moved from the use position to the stored position.

* * * * *